United States Patent [19]

Schonberg

[11] Patent Number: 5,069,325

[45] Date of Patent: Dec. 3, 1991

[54] COIN OPERATED SHOPPING CART RENTAL SYSTEM

[75] Inventor: David J. Schonberg, Rte. 3, Box 353, Alexandria, Minn. 56308

[73] Assignee: David J. Schonberg, Alexandria, Minn.

[21] Appl. No.: 386,510

[22] Filed: Jul. 28, 1989

[51] Int. Cl.[5] ..... G07F 17/00; G07F 11/62

[52] U.S. Cl. ..... 194/235; 194/229; 194/905

[58] Field of Search ..... 194/212, 229, 232, 234, 194/235, 253, 905, 247, 249, 259; 211/9

[56] References Cited

U.S. PATENT DOCUMENTS

| | | | |
|---|---|---|---|
| 2,753,970 | 3/1952 | Breeler | 194/283 |
| 3,897,863 | 8/1975 | Peggs | 194/212 |
| 4,424,893 | 1/1984 | Gillet | 194/212 |
| 4,618,050 | 10/1986 | Payraudeau | 194/905 X |
| 4,635,782 | 1/1987 | Wieth et al. | 194/905 X |
| 4,637,507 | 1/1987 | Ricouard et al. | 194/212 |
| 4,691,816 | 9/1987 | Trubiano | 194/212 |
| 4,766,989 | 8/1988 | Maloeuvre et al. | 194/905 X |

FOREIGN PATENT DOCUMENTS

| | | | |
|---|---|---|---|
| 3508772 | 10/1986 | Fed. Rep. of Germany | 194/905 |
| 7316849 | 6/1975 | Netherlands | 194/905 |

*Primary Examiner*—Frank E. Werner
*Assistant Examiner*—Scott L. Lowe

[57] ABSTRACT

A shopping cart rental system containing one or more stations (49) per shopping center, several locking mechanisms (43) per station, and one shopping cart per locking mechanism. A bail (23) permanently fastened to a shopping cart locks into the locking mechanism. Three quarters inserted into the three coin slots (28) and simultaneously depressed by the flap (34) mechanically unlock the bail, releasing the cart. When the cart is returned and the bail is reinserted into the locking mechanism, the locking mechanism once again secures the bail in place and at the same time returns, by mechanical actuation only, one of the three quarters that was initially used to release the cart.

11 Claims, 7 Drawing Sheets

COIN OPERATED SHOPPING CART RENTAL SYSTEM

BACKGROUND—FIELD OF INVENTION

This invention pertains to a shopping cart rental system and especially to the coin operated locking mechanism which is the heart of the system.

BACKGROUND

For some years we have made a business of providing rental carts in various shopping malls for the convenience of shoppers. At each main entrance to a mall we placed a station containing 6–8 wooden shopping carts. Initially, our program operated entirely upon the honor system. There was no attendant. There were no coin mechanisms. A simple sign instructed customers to put 35 cents into a coin box, take a cart, and please return it when done shopping. We operated our cart rental business in this fashion from April of 1979 through July of 1988. We began in a single mall in Minnesota. We are currently in five malls in Minnesota.

There are enough honest people to make the honor system work adequately well. Nevertheless, over the years the honor system has slowly deteriorated. I decided the time had come to convert over to a coin operated system. It soon became evident that I had a problem.

I needed an inexpensive, portable locking mechanism that would operate without electricity and that would also refund a quarter everytime a cart was returned.

I wanted it to be inexpensive so that I could afford to place a station at each mall entrance rather than at only one inconvenient location. I wanted it to be inexpensive for another reason: I wanted to be able to provide service to smaller malls which might not have enough customers to justify an expensive system.

I wanted it portable so that janitors could easily move it around for cleaning purposes or for rearranging mall fixtures.

I wanted it to operate without electricity so that (1) there would be no cords to mess with, (2) so that the location of electrical outlets would not determine where I could place my rental stations, (3) so that I would not have to make arrangements to buy electricity, and (4) so that I would not have to worry about shock hazards.

I wanted it to refund a quarter every time a cart was brought back. This refund provides an incentive to the customer to return the carts to the cart station rather than leaving them abandoned around the mall.

I shopped around but found nothing to meet my needs. I found inexpensive mechanisms that could be made to dispense things without electricity. The coin operated newspaper dispenser is one such mechanism. I also found coin operated mechanisms that would refund a quarter when a cart was returned. The cart dispensers in airport terminals will do this. But these require electricity and they are not portable. I did not find any mechanism that would provide all the features I needed. Consequently, I made one. I believe this mechanism is patentable and that it makes my entire cart rental system unique and patentable as well.

My invention is the entire cart rental system, including the all mechanical coin mechanism that returns a quarter, and the cart station containing one such coin mechanism per cart, but not including the cart design which, though mine, has been around too long to be patentable.

OBJECTS AND ADVANTAGES

My cart rental invention offers several advantages over other cart rental systems with which I am familiar.

It is an improvement over the honor system because no one takes a cart without paying for it. Furthermore, the 25 cent refund when the cart is returned assures that very few carts are left scattered around the mall. Any abandoned carts are quickly returned to the station by enterprising children or by an alert custodian who does not mind getting a free quarter.

My cart rental invention has an advantage over the cart rental systems where an attendant is required to be on duty at all times. An attendant is very labor expensive. Such a system would be economically feasible only in large shopping malls, and only in one location within such a mall. My cart rental invention works very well even where it would be cost prohibitive to pay an attendant to rent out carts.

My cart rental invention has an advantage over the stationary, electrically operated cart rental systems that are often seen in airport terminals. My cart rental unit is portable. The little dispensing station (38″×72″) can be wheeled around and placed where it is most needed. It can also be moved around for easier floor maintenance. In addition, making it even more portable and versatile is that fact that it does not need to be plugged into an electrical outlet. All the moving parts are mechanically operated.

Finally, my cart rental invention has the advantage of being relatively inexpensive. It is affordable. A dispensing station can be placed not only into small malls, but even at each entrance to the small malls.

DRAWING FIGURES

Figure 2:
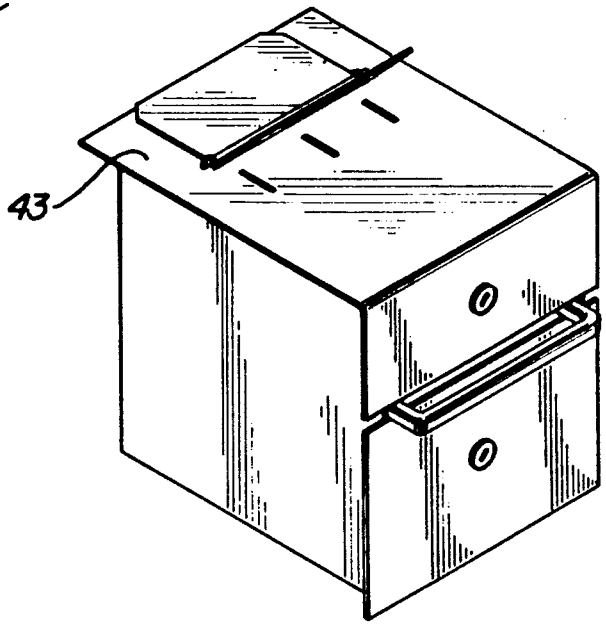
FIG. 2 shows a close up of one of the locking mechanisms in the station.

REFERENCE NUMERALS IN DRAWINGS (Arranged in Alphabetical Order)

20—adjustable link
21—adjustable stop
22—baffle wheel
23—bail
24—bail groove
25—bail opening
26—case
27—coin groove
28—coin slot
29—cover
30—cross piece
31—eject pin
32—enlarged coin groove
33—fin
34—flap
35—flipper
36—front panel
37—guides
38—guide pins
39—heavy fin
40—keyed locking device
41—latching device
42—light overhead extension spring
43—locking mechanism
44—lower arm
45—middle lower arm
46—middle upper arm
47—mounting bracket
48—secondary upper arm
49—station
50—upper arm

DESCRIPTION

Figure 4:
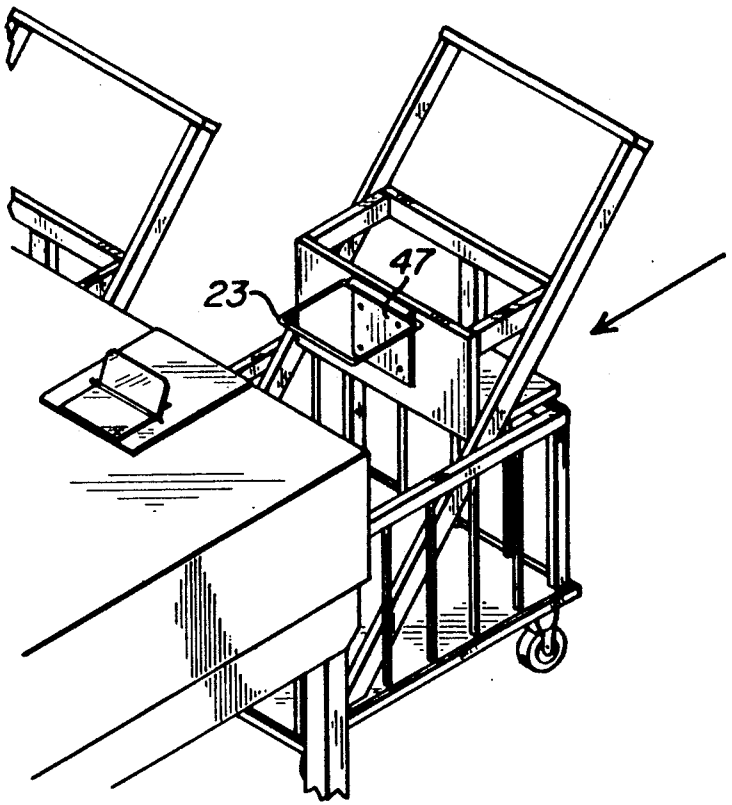
FIG. 4 shows the bail that is mounted on the cart and locks into the locking mechanism.

My invention is the entire cart rental system made up of stations 49 (FIG. 1), and several individual locking mechanisms 43 (FIG. 2) mounted in each station. There is one locking mechanism for every cart. If, for example, a shopping mall has four stations, each with six locking mechanisms, then there may be as many as twenty-four carts in the mall. The heart of this system is the actual locking mechanism 43 (FIG. 2), along with the bail 23 which is mounted on the cart and locks into the locking mechanism (FIG. 4).

Figure 1:
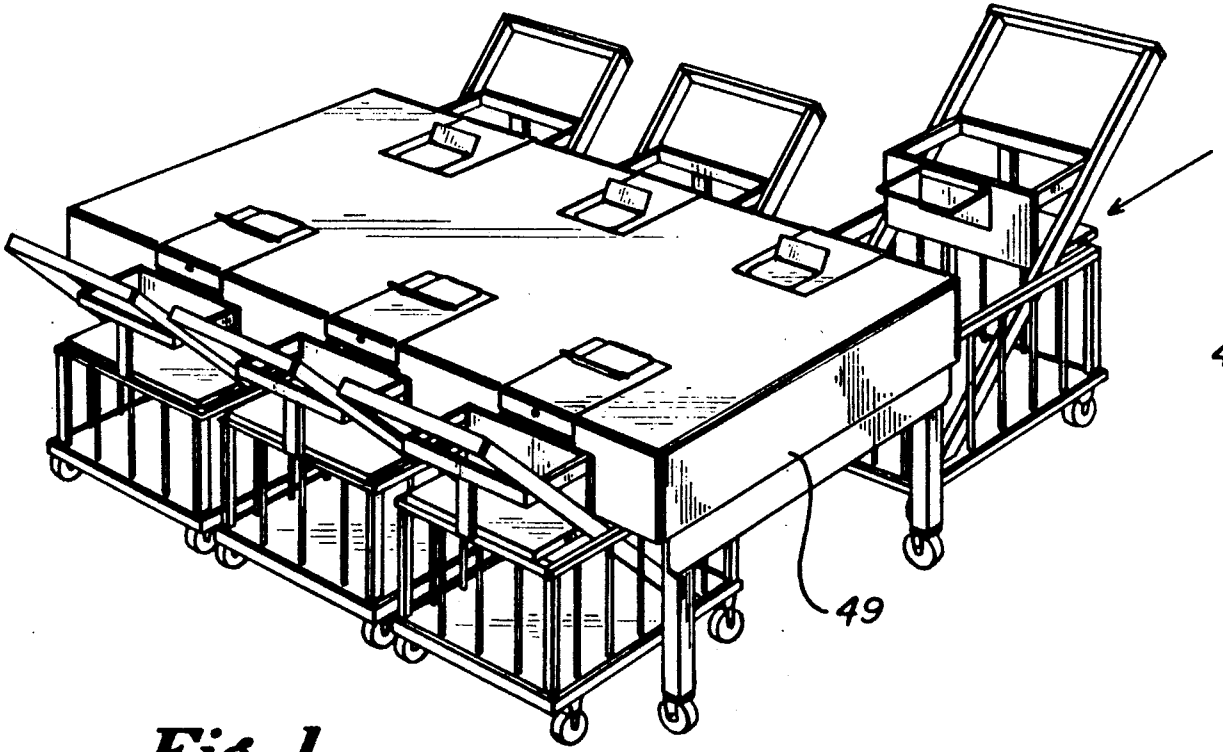
FIG. 1 shows a cart rental station.

The station 49 which contains the locking mechanisms 43 and around which the carts are parked is simply a cabinet on wheels (FIG. 1). It can be an island with carts and locking mechanisms 43 on all sides, or on two opposite sides. Or it can be positioned against a wall with carts only on one side. It may contain any number of locking mechanisms 43.

Figure 3:
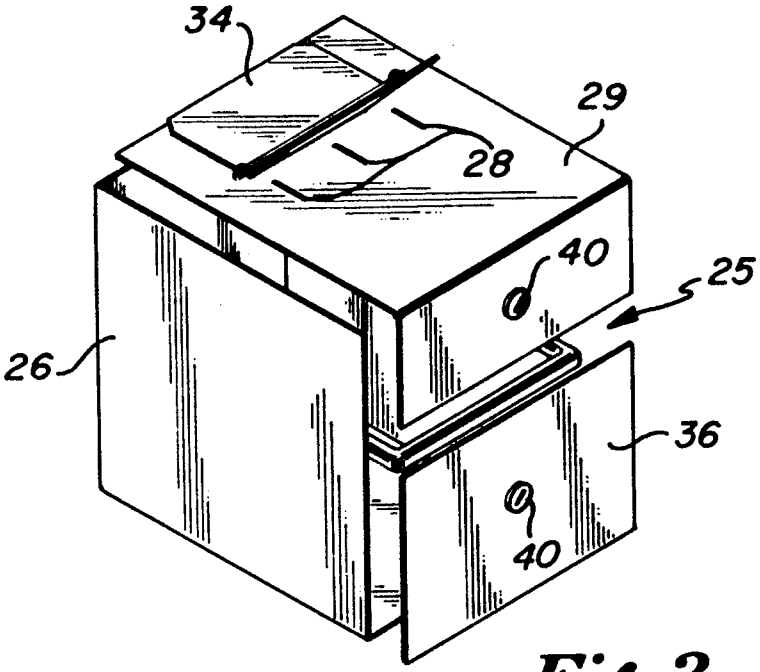
FIG. 3 shows the removable cover and the removable front panel of the locking mechanism.

The case 26 (FIG. 3) of the locking mechanism is a rectangular box that mounts in the cabinetry of the station 49. The case 26 measures approximately 7 inches wide, 10 inches high, and 10 inches deep consisting of a bottom panel, two side panels and a back panel. The cover 29 goes on top of the case 26. The front panel 36 goes on the front of the case 26.

Most of the locking mechanism 43 is hidden from view by the cabinetry which surrounds it. The only part of the locking mechanism 43 that is visible is the cover 29 and the front panel 36. The cover 29 and the front panel 36 extend over the sides and back of the case 26 by approximately ¾ of an inch. These extentions lie flush with the cabinetry and cover the rough opening in the cabinetry much like the trim around a door covers the rough opening of a doorway.

The cover 29 contains three coin slots 28. These coin slots 28 are large enough to receive quarters but not large enough to receive half dollars. The cover 29 also contains a flap 34. The purpose of the flap 34 is to simultaneously depress three quarters (see FIG. 5). The back side of the flap 34 weighs more than the front and causes the flap 34 to return to a semi-upright position when not in use. The cover 29 is secured to the main body of the case 26 by a keyed locking device 40.

The front panel 36 is also secured to the main body of the case 26 with a keyed locking device 40. The front panel 36 is reinforced to prevent breaking and entry.

Figure 8:
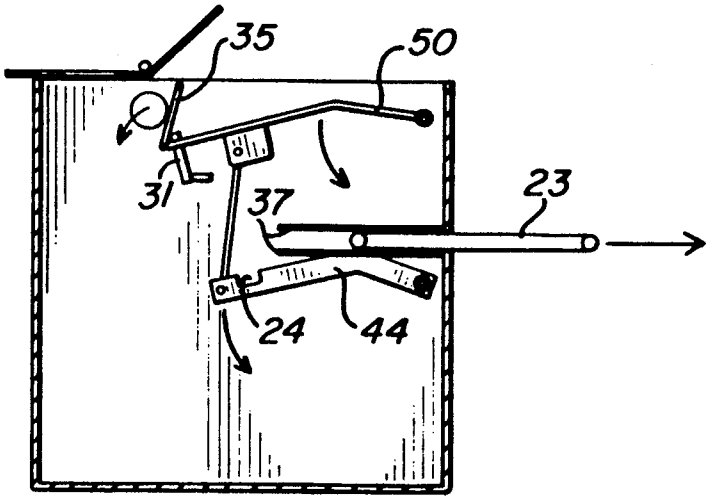
FIG. 8 shows the action of the coin flippers when the bail is being pulled out of the locking mechanism.
Figure 8A:
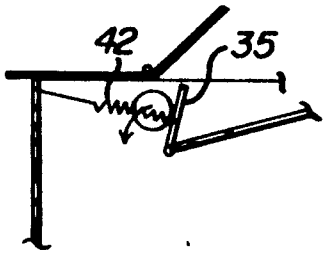

There is an opening in the front of the case 26 called the bail opening 25. It is actually a gap between the cover 29 and the front panel 36 measuring approxiamtely ½ inch high and extending the entire width of the locking mechanism 43. On each side of the bail opening 25, there is a set of guides 37 (FIG. 8). These guides are fastened to the sides of the case and direct the bail 23 (FIGS. 4 and 8) in the proper direction as it enters and leaves the locking mechanism 43 and which also support the bail 23 in the proper position once it is fully inserted.

The bail 23 (FIG. 4) is a rectangular hoop made of square or round tubing approximately ⅜ thick and being slightly narrower than the bail opening 25 into which it slides. The bail 23 is deep enough so that one end can be fastened to the cart by a mounting bracket 47 (FIG. 4) and at the same time the other end can lock into the bail groove 24 (FIG. 6) deep inside the locking mechanism 43. When the cart is pulled out of the locking mechanism 43, the bail 23 drops down and hangs from its mounting bracket 47.

Figures 5, 6:
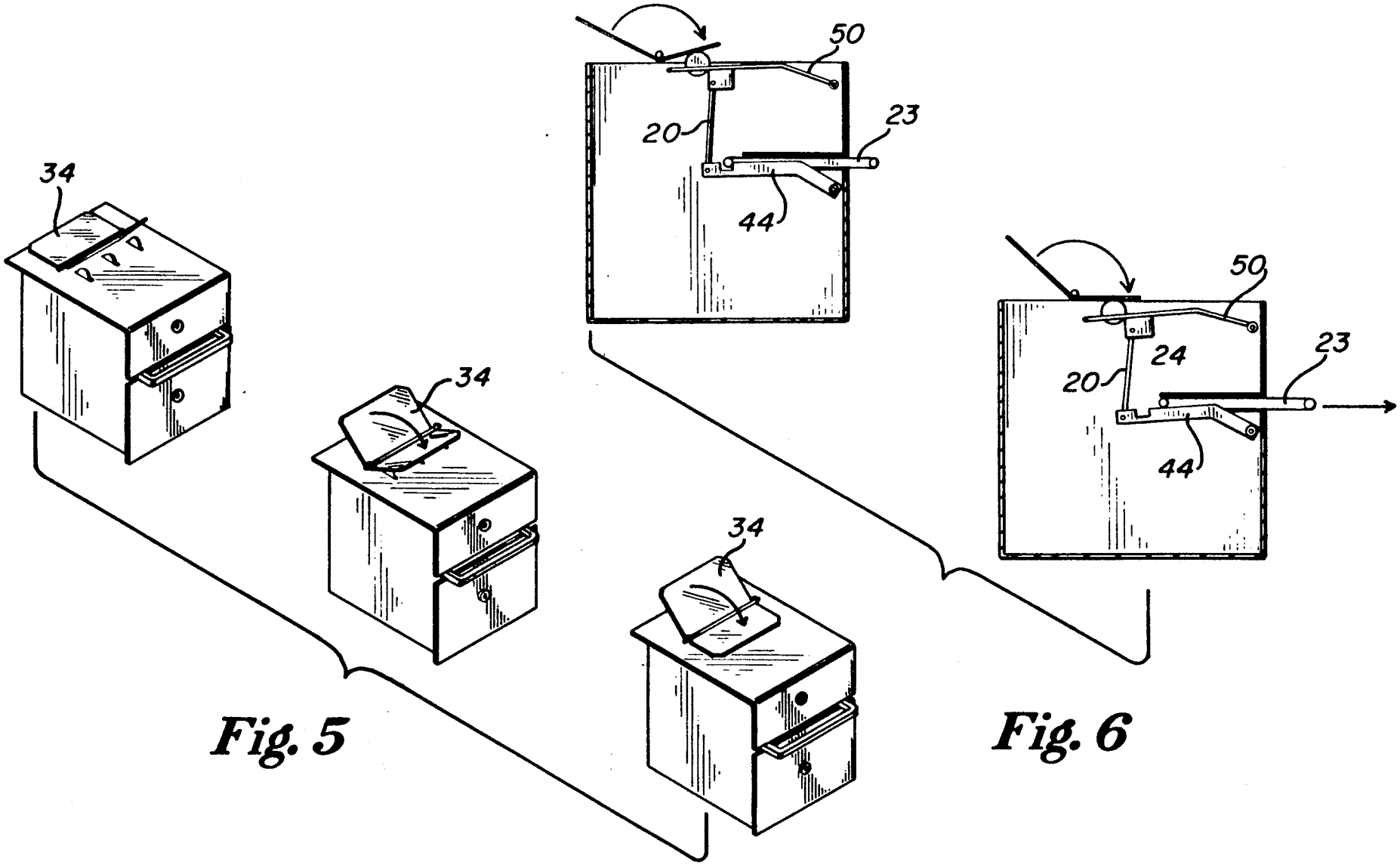
FIG. 5 shows how the coin flap depresses the three quarters simultaneously.
FIG. 6 shows how the downward, inserting motion of the quarters releases the bail.

There are three pairs of arms in this mechanism. A pair of arms is located directly below each of the three coin slots 28 in the cover 29. Each pair has an upper arm 50 and a lower arm 44 (FIG. 6). The upper arm 50 and the lower arm 44 are connected to each other by an adjustable link 20.

Figure 7:
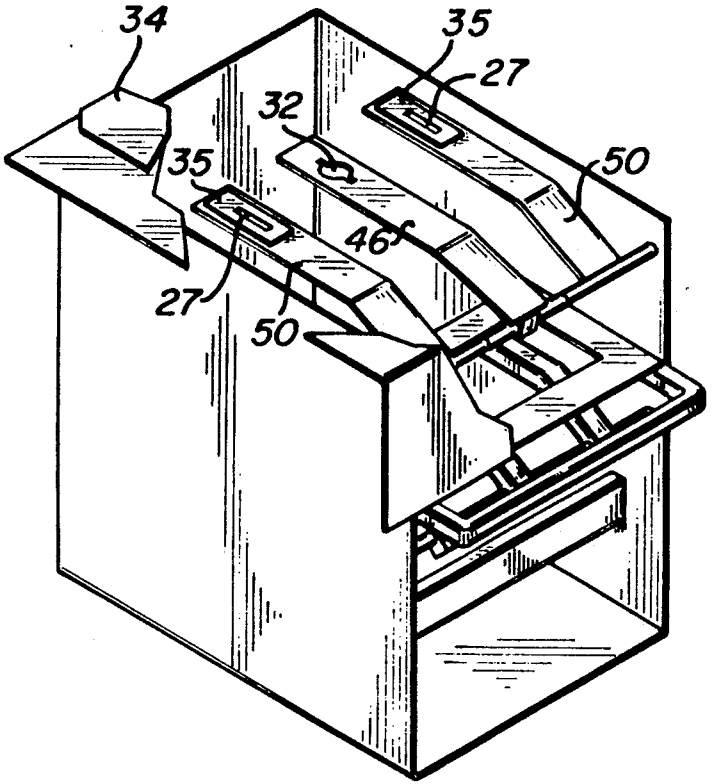
FIG. 7 shows the two flippers located on the end of two upper arms.

Each upper arm 50 contains a coin groove 27 (FIG. 7). This coin groove 27 is located at the end of the upper arm 50 and directly below the coin slot 28 in the cover 29 above it. Unlike the coin slots 28 in the cover 29, however, this coin groove 27 is intended to cradle a quarter, not to let it slip through. It is large enough to permit pennies, nickels, and dimes to fall through, but not quarters.

The coin groove 27 in two of the three upper arms 50 is actually located on a little flipper 35 (FIG. 7). These flippers 35 are built right into the end of the upper arm 50. When the upper arm 50 containing the flipper 35 is pushed down, the flipper 35 tips up causing the quarter to fall out and drop down to the bottom of the locking mechanism 43 (FIG. 8). The flipper 35 is made to tip up by means of either a small eject pin 31 (FIG. 8) which it strikes as it goes down, or by means of a light overhead extension spring 42 fastened to both the flipper 35 and to the upper back of the case 26.

The middle upper arm 46 is labeled separately from the other two upper arms 50, because, though it is actually one of the upper arms, it is a special upper arm. It has no flipper and the coin groove on the end of it bulges in the middle (to be explained later). This bulging coin groove is called an enlarged coin groove 32 (FIG. 7). In addition, the middle upper arm 46 rests upon a secondary upper arm 48 (FIG. 9) located immediately below it. The middle upper arm 46 and the secondary upper arm 48 upon which it rests are not connected to each other. When the middle upper arm 46 goes down, the secondary upper arm 48 below it is naturally forced to go down also. But, since they are not connected in any way, the secondary upper arm 48 may go further down than the middle upper arm 46. This is important to remember.

The middle upper arm 46 is not permitted the full up and down travel that the other two upper arms 50 have. There is an adjustable stop 21 (FIG. 9) that prevents the middle upper arm 46 from going down beyond a certain point. Once the middle upper arm 46 comes to rest on the adjustable stop 21 the middle upper arm 46 can go down no further. The secondary upper arm 48 beneath it may go farther down, but the middle upper arm 46 being restrained by the adjustable stop 21 cannot.

Figure 9:
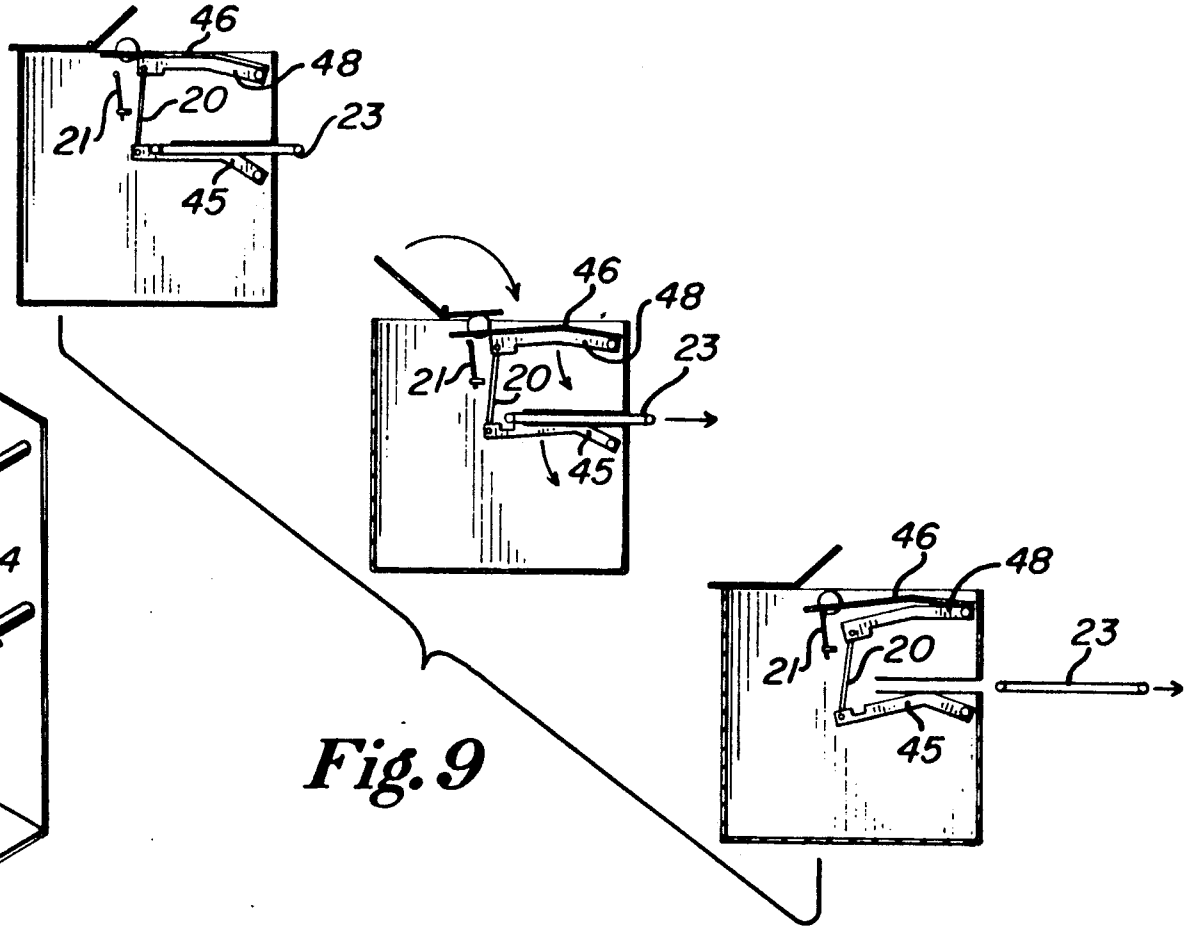
FIG. 9 shows the action of the middle upper arm containing the returnable quarter.

An adjustable link 20 connects the upper and lower arms together (FIG. 9). (In the case of the middle upper arm 46, it is the secondary upper arm 48 beneath the middle upper arm 46 that is actually connected to the lower arm 44.)

Each of the lower arms 44 has a bail groove 24 (FIG. 8) in it about ¼ inch deep and ¾ inch long. This bail groove 24 is what locks the bail 23 in place. All three lower arms 44 contain upward spring tension causing the bail groove 24 in each lower arm 44 to individually lock around the bail 23 once the bail 23 slides over the bail groove 24. To overcome this spring tension a quarter must be pressed down through a coin slot 28 in the cover 29. The quarter presses the upper arm 50 down; the upper arm 50 being connected to the lower arm 44 by the adjustable link 20 presses the lower arm 44 down. As the lower arm 44 goes down, the bail groove 24 retreats from around the bail 23 which releases the bail 23 from that particular bail groove 24. Only when all three lower arms 44 are simultaneously pushed down is the bail 23 free to slide out of the locking mechanism 43.

Figure 10:
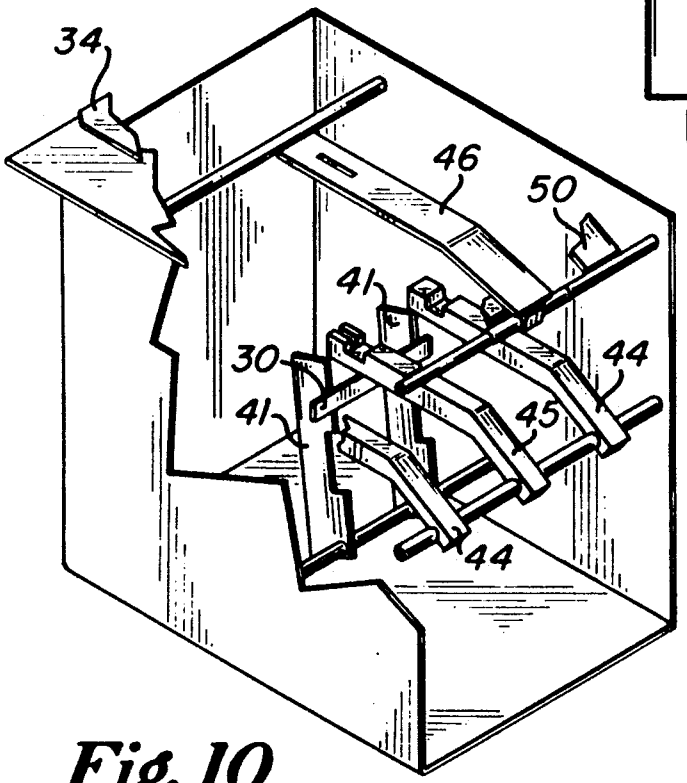
FIG. 10 shows the two latching devices.
Figures 11, 12:
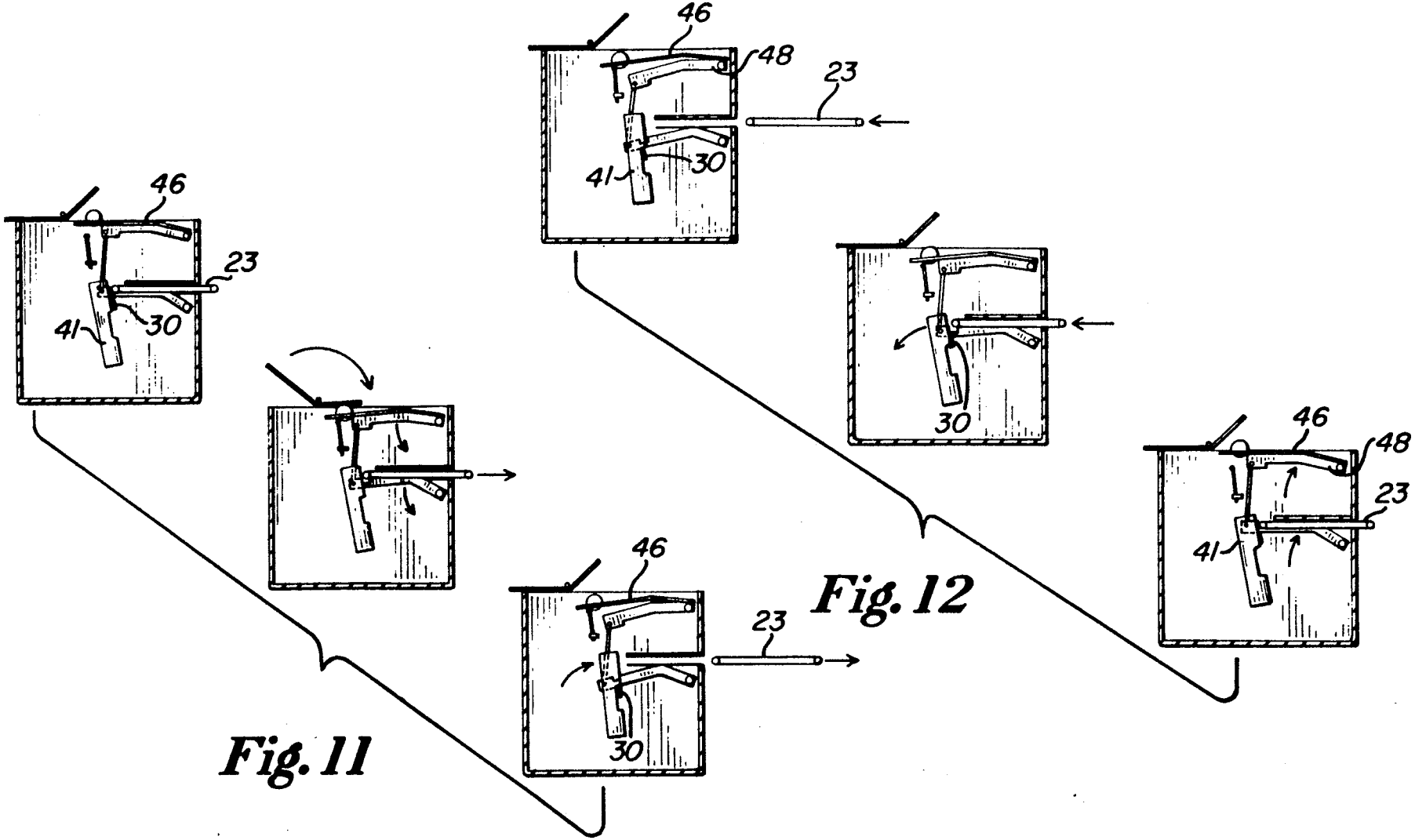
FIG. 11 shows how the two latching devices catch and hold down the middle upper arm when the middle upper arm is depressed.
FIG. 12 shows how the middle upper arm with its quarter is released from its depressed position when the bail is inserted.

The middle lower arm 45 (FIG. 10) is spring loaded just like the other two lower arms 44. There is a difference, however, between the middle lower arm 45 and the other two lower arms 44. The middle lower arm 45 has a three inch wide cross piece 30 fastened underneath. If the middle lower arm 45 is depressed to a certain point, this cross piece 30 locks into a spring loaded latching device 41 (FIGS. 10 and 11). When this occurs, even though the two lower arms 44 on either side are free to go back up, the middle lower arm 45 stays down. Only when something is inserted into the bail opening 25 and pushes the latching device 41 away from the cross piece 30 is the middle lower arm 45 free to go back up. Remember this function. In the next section I will explain how it serves to return a quarter when the bail 23 of the shopping cart is inserted into the locking mechanism 43.

Figure 15:
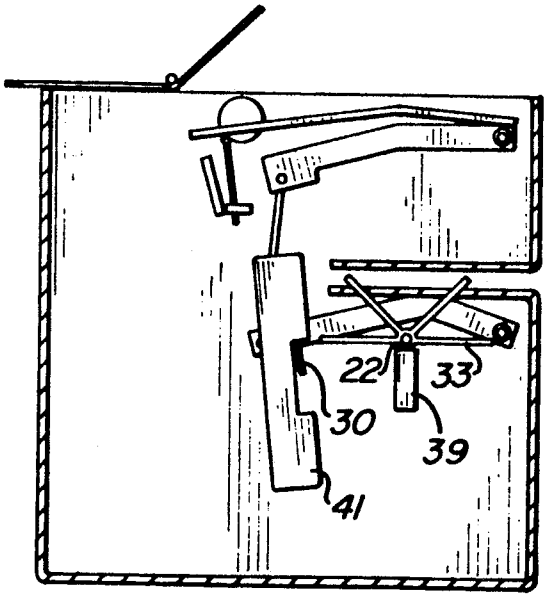
FIG. 15 shows side view of revolving baffle wheels that prevent someone from inserting a stick or a piece of cardboard into the locking mechanism in order to release and steal the waiting quarter.

Two baffle wheels 22 (FIG. 15) are installed to discourage tampering. Each baffle wheel 22 is approximately 3" in diameter and 1½ inches wide. Each baffle wheel 22 has several fins 33. One of the fins is called the heavy fin 39. This heavy fin 39 is much heavier than the other fins 33, causing the baffle wheel 22 to always come to rest with the heavy fin 39 pointing down and the other fins 33 always in a position that will receive the bail 23, but which will intercept foreign objects such as pencils or pieces of cardboard. These baffle wheels 22 are located side by side in the two spaces between the three lower arms 44 and directly in front of the cross piece 30/latching device 41. Thus they protect the parts that are responsible for releasing the quarter at the proper time. The baffle wheels 22 rotate on a common axle secured to the sides of the case 26 of the locking mechanism 43.

OPERATION

To illustrate how my invention works let us follow the lady who is carrying a purse and a small child in one hand and hanging on to a very lively three year old with the other. She has spotted our rental carts and moves immediately toward them. She lays her baby down on top of the portable station 49 and begins looking through her purse for some quarters. She finds her quarters and begins reading the instructions. This is what she reads:

1. Drop a quarter in each slot.
2. Press quarters down with metal flap. While holding flap down, pull out cart.
3. To get 1 quarter back, return cart to any available space and insert metal hoop into coinbox.

She drops a quarter in each coin slot 28. Even though the coin slots 28 in the cover 29 are large enough to receive a quarter the quarters do not drop through. Almost half of the quarter is still sticking out. That is because they have come to rest in the slightly smaller coin grooves 27 located on the ends of the upper arms 50 which are located directly below the coin slots 28 in the cover 29. With one hand she presses down on the metal flap 34. As she does so, all three quarters are pressed down simultaneously. As the quarters go down, the upper arms 50 go down. When the upper arms 50 go down, the lower arms 44 also go down because they are connected to the upper arms 50 with an adjustable link 20. As the lower arms 44 go down, the bail groove 24 in each of the lower arms 44 which locks the bail 23 in place is forced away from the bail 23 and the cart is no longer held in place by the bail grooves 24. It is free to be pulled out. Holding down the metal flap 34 with one hand, the lady pulls the cart out with the other hand.

Let us back up to the point where the lady is searching in her purse for quarters. Let us imagine that she could only find two quarters. Being desperate for a cart, she decides to try get a cart with two quarters instead of with three. She inserts two quarters and presses the metal flap 34 down. Everything works as before, except that one upper arm 50 does not go down and neither does the lower arm 44 to which it is connected. Consequently, the bail groove 24 in that particular lower arm 44 is not forced away from the bail 23, and the cart stays locked in place. Two of the three bail grooves 24 have released their hold on the bail 23, but one has not, and that one is enough to keep the cart locked in place.

Realizing that two quarters will not release the cart, the lady lets up on the metal flap 34 and starts looking around in her purse again. She finds a nickel and decides to try two quarters and a nickel. But when she drops the nickel in the coin slot 28, it disappears and she hears it clink on the bottom of the locking mechanism 43. The reason it disappeared is because, though the coin groove 27 on the end of each of the upper arms 50 is too small to let quarters slip through, it is not too small to let nickels, pennies and dimes slip through. Consequently, by trying to cheat the system, the lady just lost a nickel.

It is easy to see how three quarters, depressed simultaneously, could release the bail 23 of the cart. It is a little harder to understand why all three quarters do not immediately pop back up when the cart is pulled out. Let us follow in slow motion what happens on the inside of the locking mechanism 43 when the lady pulls on the handle of the cart causing the bail 23 to slide out of the locking mechanism 43.

Notice, first of all, that each of the lower arms 44 is not straight but curved. This upward curve gets in the way of the bail 23 as the bail 23 begins to slide out. One of two things is going to happen: either the bail 23 is going to bind and stick tight, frustrating the lady's attempts to withdraw the cart, or the bail 23 is going to force the curved part of the lower arm 44 down and out of its way. Fortunately, the spring tension holding the lower arms 44 in the up position is not very strong. The lower arms 44 do not want to go down, but neither do they resist very much. In the end the lower arms 44 give way and go down, letting the bail 23 slide out.

In the process of releasing the bail 23 something else happens. Each lower arm 44 is connected to an upper arm 50 by an adjustable link 20. (In the case of the middle pair of arms the middle lower arm 45 is connected to the secondary upper arm 48 located immediately beneath the middle upper arm 46.) As the lower arms 44 (including the middle lower arm 45) go down, so also do the upper arms 50 (including the middle upper arm 46). Since each upper arm 50 is holding a quarter, the quarters also go down. Two of the lady's quarters are riding in little flippers 35 located on the ends of two of the upper arms 50. The nice little ride down is suddenly interrupted. The flippers 35 come down hard against stationary eject pins 31 which cause the flippers 35 to tip up (FIG. 8). (A slightly different process accomplishing the same thing is done by means of a light overhead extension spring 42 with one end fastened to the flipper 35 and the other end fastened to the case 26. As the upper arms 50 go down, the light overhead extension spring 42 tightens and tips up the flipper 35.) As the flippers 35 tip up the quarters tumble out and fall to the bottom of the locking mechanism 43 where they remain until the keyed front panel 36 is removed and all the quarters (along with any pennies, nickels, and dimes) are collected.

The lady's third quarter (the one in the center coin slot 28) encounters a different adventure. Like the quarter on either side, the center quarter takes a trip down. Unlike the other quarters, however, it is not riding in a flipper 35, but in the enlarged coin groove 32 of the middle upper arm 46. This quarter does not go down as far as the others. Instead, the middle upper arm 46 on which it is riding comes to rest on an adjustable stop 21. The secondary upper arm 48 below it and upon which the middle upper arm 46 normally rests draws away from the middle upper arm 46 and continues its trip downward. The middle upper arm 46, however, remains suspended on the adjustable stop 21 until such time as the secondary upper arm 48 beneath it should come back up and lift it off the adjustable stop 21 and carry it back up to its place directly below the cover 29.

While the other two quarters are tumbling out and falling to the bottom of the locking mechanism 43, the center quarter rests quietly in the darkness cradled in the enlarged coin groove 32 of the middle upper arm 46. The top of the quarter is now approximately ½ inch below the center coin slot 28 in the cover 29. It is barely visible from above, and well out of reach of little boys with toothpicks and bubblegum who might try to fish it out.

Whereas the upper arms 50 on either side of the middle pair of arms go down, tip out their quarters, and pop back up again, the center set of arms (middle lower arm 45, middle upper arm 46, and the secondary upper arm 48) remain in the down position. This is what happens:

When the bail 23 was sliding out, forcing the curved lower arms 44 to go further and further down just to get out of the bail's way, the cross piece 30 that is fastened to the bottom of the middle lower arm 45 was sliding down the vertical edge of the two latching devices 41. Suddenly each of the two spring loaded latching devices 41 leaped forward as the descending cross piece 30 traveled past the recessed notch in each of the latching devices 41. When the bail 23 was finally out and the three lower arms 44 made a move to return to the up position, the cross piece 30 on the bottom of the middle lower arm 45 got caught in the notches of the two spring loaded latching devices 41. Consequently, the middle set of arms could not return back up with the other two pairs of arms.

During the cart's absence, the middle set of arms (middle lower arm 45, middle upper arm 46, and secondary upper arm 48) remain in the down position. This also includes the quarter resting in the enlarged coin groove 32 on the end of the middle upper arm 46.

Little boys tried to fish the quarter out with toothpicks, paper clips, and bubblegum. They could not get it out because it was too far down.

Teenage boys came along with pencils and carboard and tried to release the latching device 41 so that the middle lower arm 45 would spring up and pop the quarter back out through the coin slot 28 in the cover 29. They could not do it because the two baffle wheels 22 prevented the cardboard and pencils from reaching the latching device 41. One smart boy came the closest to stealing the quarter by inserting an L shaped bar which slipped through the fins 33 of the baffle wheel 22 much like the bail 23 of the cart would do. Unfortunately for the boy, his bar only released one of the latching devices 41. Both latching devices 41 must be released and they are spread apart so that only a very special bar (the bail 23) will work.

By the time the lady finished shopping, the boys had given up and had gone away. During her absence other shoppers had rented carts and returned carts. In fact, the particular locking mechanism 43 from which the lady had rented her cart is now occupied by another cart. No matter! The quarter she was expecting to get back is in someone else's pocket, but soon she will have the quarter that is waiting in another vacant locking mechanism 43. She finds a vacant locking mechanism 43 and inserts the bail 23 which is mounted on the cart into the bail opening 25 and pushes. Two pairs of arms once again go down, making way for the bail 23 to enter. The flippers 35 go through their flipping motions, but of course this time there are no quarters to tip out. The middle pair of arms is already down having been detained by the cross piece 30 in the latching device 41 from when someone had removed its cart sometime earlier. As the bail 23 travels further in, it finds its way through the fins 33 of the baffle wheels 22 which rotate on a common axle permitting the bail 23 to enter still further. By now the bail 23 has advanced beyond the high point of the curve on the lower arms 44 and the two outside pairs are once again moving upward.

At almost the same time two things occur. The first thing is that the bail 23 passes over the bail groove 24 in two of the lower arms 44—the lower arms that are on either side of the middle set of arms. Both of these lower arms 44, under spring tension, snap up and lock the bail 23 in place. Secondly, even while the bail 23 is moving forward over the bail grooves 24 in the two lower arms 44, it is also beginning to push against the two spring loaded latching devices 41. Immediately after the two lower arms 44 lock their bail grooves 24 around the incoming bail 23, the bail 23 also pushes the two latching devices 41 away from the crosspiece 30. When this happens the middle lower arm 45 which has been held in the down position ever since the last person pulled a cart out to go shopping is suddenly released. Now it, too, springs up and locks its bail groove 24 around the bail 23. But it also does something else.

Figure 14:
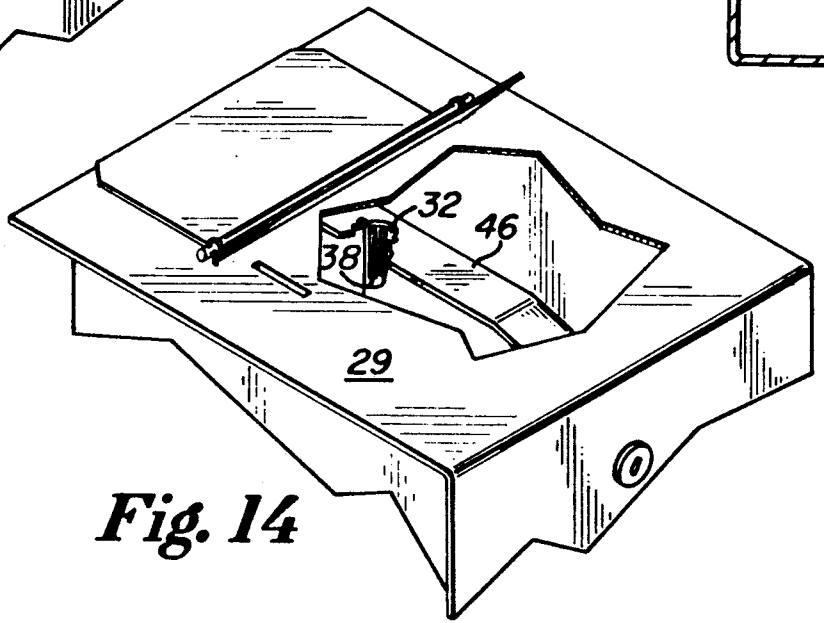
FIG. 14 shows how the enlarged coin groove in middle upper arm permits the middle upper arm to travel all the way up to the cover without hitting the two guide pins.
Figure 13:
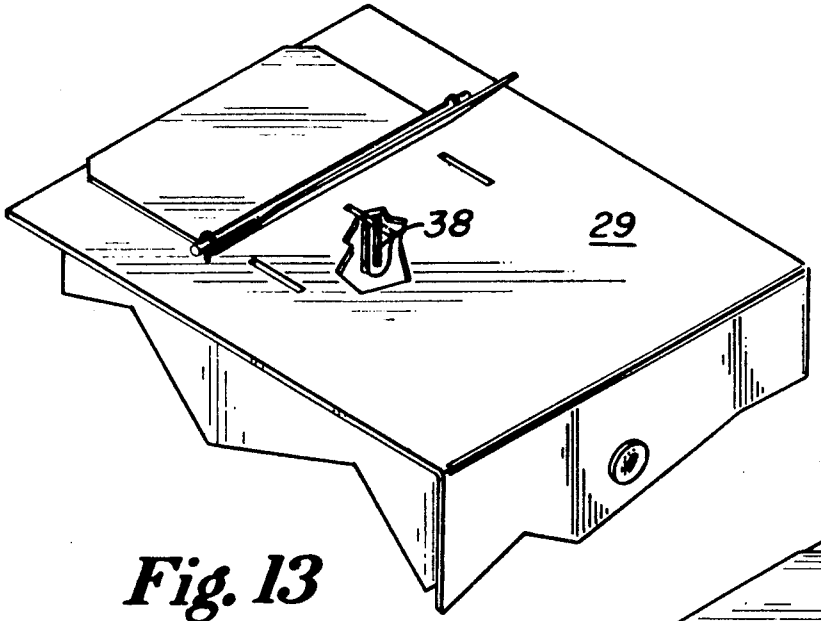
FIG. 13 shows the two guide pins on the under side of the cover for directing the center quarter back up through the center coin slot.

In the process of springing up, the middle lower arm 45 which is connected to the secondary upper arm 48 by an adjustable link 20 forces the secondary upper arm 48 upward. The secondary upper arm 48 bumps up underneath the middle upper arm 46, forcing the middle upper arm 46 upward. The middle upper arm 46 has been holding a quarter all this time. When the middle upper arm 46 goes up, the quarter is pushed up. The two guide pins 38 (FIGS. 13 and 14) direct the quarter through the center coin slot 28 in the cover 29. At this point the enlarged coin groove 32 in the middle upper arm 46 comes into play.

Without the enlarged coin groove 32 in the end of the middle upper arm 46 the returning middle upper arm 46 would strike against the two guide pins 38. The two guide pins 38 which extend a considerable distance below the cover 29 would prevent the the middle upper arm 46 from traveling all the way up. Having an enlarged coin groove 32 at the end of the middle upper arm 46, however, permits the middle upper arm 46 to go up on either side of the two guide pins 38 pushing the quarter right out of the coin slot 28 in the cover 29. The lady picks up her quarter and goes home.

CONCLUSION, RAMIFICATIONS, AND SCOPE OF INVENTION

Printed descriptions and drawings fail to reveal the beauty and simplicity of my invention. Shoppers of all ages from little children to old people are delighted by our shopping cart rental program. It is easy to operate and inexpensive to use. Young and old alike are fascinated by the quarter that pops back up when a cart is returned. It is almost as much fun to watch it happen as to get the quarter back.

Shopping malls are delighted with our cart rental system. It is the only system that I am aware of that:

1. has portable stations
2. uses an individual locking mechanism for each cart
3. has an all mechanical coin return requiring no electrical cords, outlets, or electric meters.
4. is economically feasible not only for small malls but for individual entrances within these small malls.

There may be other applications for my invention that are not included in this description. The coin mechanism, itself, could be used to lock and release other things beside shopping carts. It may be made to handle coins other than quarters and to function with more than or less than three coins. Although the description above is rather specific, it should not be construed to limit the scope of my invention, but rather to illustrate it. The scope of the invention should be determined by the appended claims and their legal equivalents, rather than by the illustrations given.

I claim:

1. A rental system comprising a plurality of stations, each station being comprised of several locking mechanisms, each of said locking mechanisms releasably engaging and interlocking a locking element on a portable device, each of said locking mechanisms comprising, a housing including an upper wall and outer walls, a plurality of similar coin openings in said upper wall, a locking opening in one of said outer walls for receiving the locking element on a portable device therein, a plurality of locking members positioned within said housing and being shiftable between locking and release positions, said locking members when in the locking position engaging and retaining the locking element of a portable device when the locking element is moved into said locking opening, a plurality of actuators shiftably mounted within said housing for shifting movement between a normal locking position and a release position, and being operatively interrelated with said locking members, each actuator including means for supporting a coin inserted into one of the coin openings, said actuators being shiftable in response to movement of the coins through the openings in the upper wall to shift the locking members to a release position and to thereby release the locking element on the portable device, the coin on one actuator being retained thereon, each coin on the other of said actuators being displaced therefrom during shifting movement of the actuators, means in said housing engaging said one actuator for retaining the same in the release position, whereby when the locking element on a portable device is inserted into the locking opening in said housing, the locking element will cause said one actuator to return the coin thereon through the coin opening, and said locking members will engage the locking element on the portable device to thereby lock the portable device.

2. The rental system as defined in claim 1 wherein said locking members are mounted within said housing for vertically shiftable movement relative thereto.

3. The rental system as defined in claim 2 wherein said locking members are normally urged to the locking position.

4. The rental system as defined in claim 3 wherein said locking members are engaged by the locking element on a portable device and are vertically shifted in a camming action during withdrawal and insertion of the locking element of a portable device.

5. The rental system as defined in claim 1 wherein the coins inserted into the coin openings project upwardly beyond the upper wall when said actuators are in the locking position, and means on said housing for simultaneously engaging all of the coins to forcibly urge the coins and actuators vertically in a release direction.

6. The rental system as defined in claim 1 wherein said locking members comprise elongate generally horizontally disposed arms each being vertically pivotal about a common horizontal axis.

7. The rental system as defined in claim 1 wherein said actuators comprise elongate generally horizontally disposed arms each being vertically pivotal about a common horizontal axis.

8. The rental system as defined in claim 1 and means within the housing engaging the coins supported on the other of said actuators during movement of the latter in a release direction to displace the coins from the actuators.

9. The rental system as defined in claim 1 and a plurality of link elements each interconnecting one of said locking members with one of said actuators.

10. The rental system as defined in claim 1, wherein said several locking mechanisms are mounted within a cabinet structure.

11. The rental system as defined in claim 1 and shiftable means interrelated with said locking members and obstructing the insertion of an object other than the locking element on the portable device.

* * * * *